US005085120A

United States Patent [19]

Ishiguro

[11] Patent Number: 5,085,120

[45] Date of Patent: Feb. 4, 1992

[54] ELECTRONIC STRINGED MUSICAL INSTRUMENT WITH PARAMETER SELECTING FUNCTION

[75] Inventor: Shiro Ishiguro, Tachikawa, Japan

[73] Assignee: Casio Computer Co., Ltd., Tokyo, Japan

[21] Appl. No.: 453,955

[22] Filed: Dec. 20, 1989

[30] Foreign Application Priority Data

Dec. 26, 1988 [JP] Japan ..... 63-167912[U]

[51] Int. Cl.[5] ..... G10H 1/02

[52] U.S. Cl. ..... 84/737; 84/739; 84/740

[58] Field of Search ..... 84/701-703, 84/718, 723, 734-743, 653, 662, 670, 678, 705

[56] References Cited

U.S. PATENT DOCUMENTS

| | | | |
|---|---|---|---|
| 3,743,751 | 7/1973 | Ibanez . | |
| 4,387,621 | 6/1983 | Franzmann | 84/739 |
| 4,516,462 | 5/1985 | Schulze | 84/739 |
| 4,658,690 | 4/1987 | Aitken et al. | 84/629 |
| 4,817,484 | 4/1989 | Iba et al. | 84/735 |
| 4,915,007 | 4/1990 | Wachi et al. | 84/622 |
| 4,919,031 | 4/1990 | Matsumoto | 84/701 X |
| 4,951,546 | 8/1990 | Takabayashi et al. | 84/718 |
| 5,038,657 | 8/1991 | Busley | 84/455 |

FOREIGN PATENT DOCUMENTS 57-52596 11/1982 Japan .

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

An electronic musical instrument having a function of selecting a musical tone parameter just before, or after during a musical performance is provided. The instrument has a first manually operable element such as a tremolo arm deflectably mounted on the main body of the instrument and positioned adjacent to stretched strings, and a second manually operable element (e.g., push button) attached to the first operational element. In one embodiment, the first element serves as a controller for varying a first musical parameter (e.g., pitch modulation) while the second element functions as another controller for varying a second, different musical parameter (e.g., tone color). In another embodiment, the second element serves as a variable function assignor for the first element. Depending on the function assigning of the first element, the second element provides a variable parameter controller (e.g., tremolo, vibrato). In either case a player can select the musical tone parameter at hand speedily and surely without any substantial interruption of playing the strings, whereby the music performance will be enriched and diversified.

10 Claims, 4 Drawing Sheets

ELECTRONIC STRINGED MUSICAL INSTRUMENT WITH PARAMETER SELECTING FUNCTION

BACKGROUND OF THE INVENTION

1. Field of the Invention

The present invention relates to an electronic stringed musical instrument, and more specifically to an electronic stringed musical instrument having a function of selecting a desired musical tone parameter just before and during musical performance by a user.

2. Description of the Prior Art

An electronic stringed musical instrument is well known in which a head portion and a body portion are formed integral with a neck portion at its opposite ends. A fingerboard is constructed on the neck portion for a fingering operation. A plurality of strings are stretched along the fingerboard. Various switches e.g., timbre (tone color) selection switches, rhythm selection switches and automatic rhythm performance start/stop switch are arranged on the upper surface of the body portion. In addition a tremolo or vibrato arm is arranged on the body portion for varying a pitch of musical tone or tones which are being sounded by plucking strumming, or picking operation of the strings. Inside of the body portion, a tone generation circuit is provided to synthesize such musical tones.

With a stringed musical instrument of this kind, a large number of tone parameter selection switches must be arranged on the surface of the body portion in order to accomplish the instrument functions required.

However, arranging such a large number of the musical tone parameter selection switches over the body surface does increase the cost of parts. If the space of the body is small, it is difficult to arrange and mount those switches on it. Further, a player normally plays the stringed musical instrument by using both hands to operate the strings so that during the performance, the player cannot easily operate the musical tone parameter selection switches arranged over the body surface; the only exception may be to operate the tremolo arm since it is positioned adjacent to the location where the strings are plucked. Therefore, whenever the player attempts to change the parameter of musical tone by operating the switches, he or she must suspend or interrupt the musical performance of the instrument for the parameter change. This restricts the musicality of the performance.

In order to perform music more realistically, it is desired to provide a stringed instrument with which not only the kind of the tone parameters but also the values of the selected parameter can be changed at hand during the performance.

In the state of the art, however, the tremolo arm positioned adjacent the strings is used merely for varying the pitch of the musical tone during the performance. Japanese patent publication gazette No. (TOKKOU SHO) 57-52596 shows an apparatus which can vary the values of a preselected parameter of the musical tone (pitch or volume) by operating the tremolo arm. The preselection of the parameter to be modulated by the tremolo arm operation is made by operating a mode switch disposed on the body surface, It is difficult to depress such mode switch during the performance to affect a parameter change.

SUMMARY OF THE INVENTION

Accordingly, it is an object of this invention to provide an electronic stringed musical instrument allowing the player to select at hand quickly and surely a desired parameter from various parameters of a musical tone without interrupting or impairing the musical performance.

Another object of this invention is to provide an electronic stringed musical instrument allowing varying values of the parameter selected by a musical tone parameter selecting means.

In accordance with one aspect of the present invention there is provided an electronic stringed musical instrument which comprises a first manually operable element deflectably mounted on the body and positioned adjacent to strings for varying a first parameter (e.g., pitch) of each musical tone to be generated, a second manually operable element attached to the first manually operable element and a musical tone parameter selecting means for variably selecting a second parameter (e.g., tone color) of each musical tone in response to operation of the second manually operated element.

With this arrangement, the first manually operable element serves as a first musical parameter controller or manipulator while the second manually operable element functions as a second controller for a second musical parameter different from the first parameter. Hence, using the first and second manually operable elements, the player can control any one or both of the first and second musical parameters as required in the course of playing the stringed instrument, this enriching the musical performance. Since the second manually operable element is attached to the first manually operable element which is deflectably mounted on the instrument body and positioned adjacent to the strings, the player will find it much easier to operate any one or both of the first and second manually operable elements even in the course of playing the stringed instrument at appropriate times between pluckings of the strings.

In accordance with another aspect of the present invention there is provided an electronic stringed musical instrument which includes a first manually operable element deflectably mounted on the body of the stringed musical instrument and being positioned adjacent to strings, a second manually operable element which is attached to the first manually operable element, a musical tone parameter selecting means coupled to the second manually operable element for variably selecting a parameter type of each musical tone, and a musical tone parameter varying means coupled to the musical tone parameter selecting means for varying a value of a parameter the type of which is selected by the musical tone parameter selecting means in accordance with an amount of deflection of the first manually operable element.

With the arrangement, the second manually operable element serves as a variable function assignor for the first manually operable element so that the latter can function as a variable parameter controller depending on the function assigning operation of the second manually operable element. This interrelated or associated combination of the first and second manually operable elements will provide a more diversified tone control capability to the stringed instrument while the mechanical arrangement of the first and second elements makes it easy for the player to manipulate these elements.

BRIEF DESCRIPTION OF THE DRAWINGS

The above and other objects and characteristics of the present invention are to be better understood by one skilled in the art according to the description of the preferred embodiments of the present invention with reference to the accompanying drawing, in which.

DETAILED DESCRIPTION OF THE PREFERRED EMBODIMENTS

Whole Outside Arrangement

Figure 1:
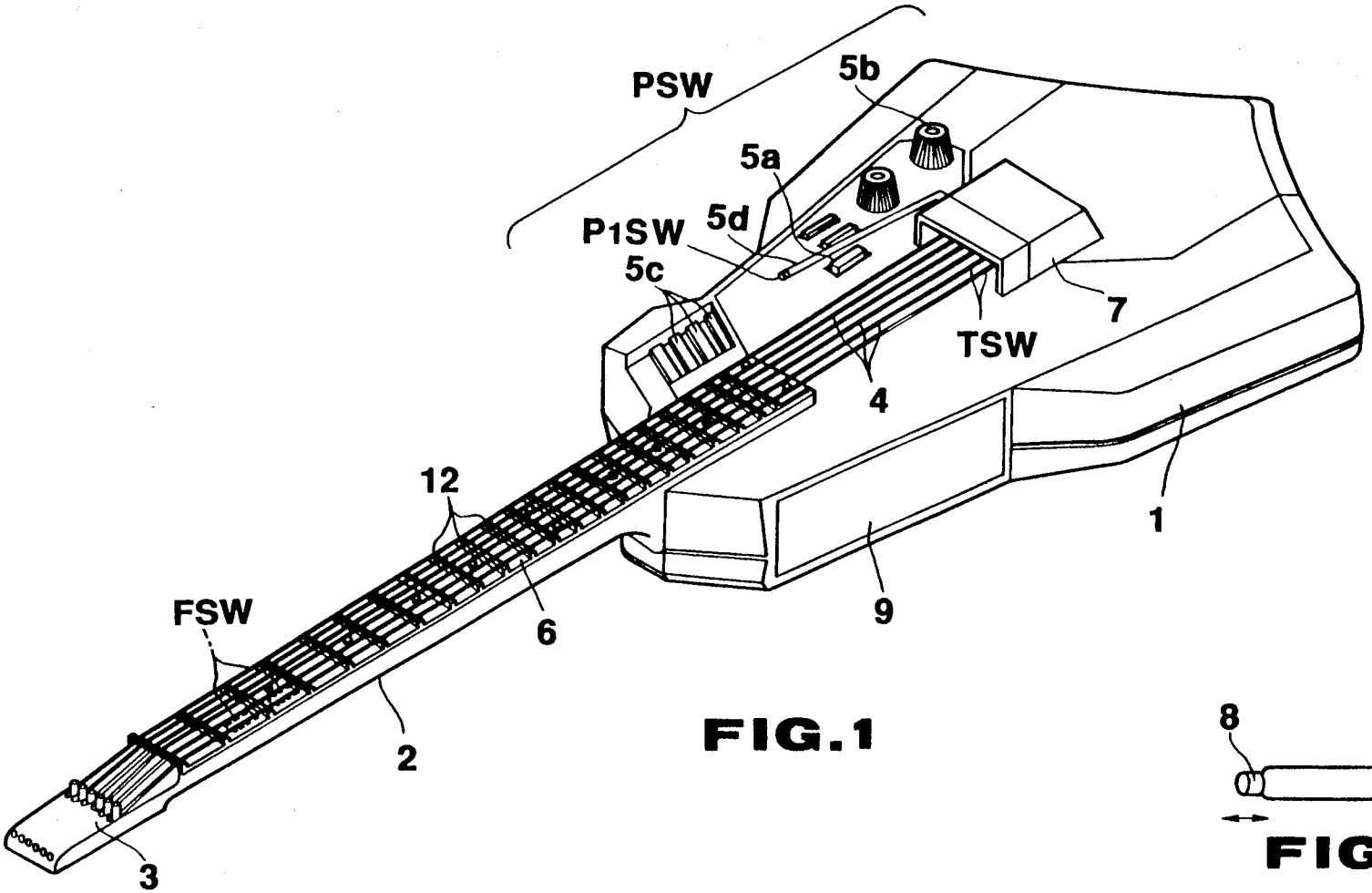
FIG. 1 is an outside view of an entire electronic stringed musical instrument of a preferred embodiment of this invention.
Figure 2:
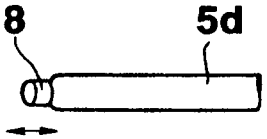
FIG. 2 is a enlarged side view of the tremolo arm shown in FIG. 1.

FIG. 1 shows a whole outside view of an electronic stringed musical instrument. The electronic stringed musical instrument has a shape of a conventional guitar, in which a body 1, a neck 2 and a head 3 are formed as one unit and strings 4 are stretched along the neck 2 over a fingerboard 6 formed on the neck 2. Various panel switches designated PSW including a rhythm start/stop switch 5*a* are arranged over an upper surface of the body 1 which also mounts a swingable tremolo arm 5*d* near the position where the strings 4 are plucked. Fret switches FSW are embedded in the fingerboard 6 in a matrix fashion each corresponding to each string-fret position. String strigger switches TSW, hidden in a case 7, are arranged at the end of the respective strings 4. The switches TSW are used for detecting vibrations of the strings 4. Tremolo arm 5*d* is adapted to modulate the pitch (frequency) of a musical tone being generated (in a tone generator (TG) 13) in proportion to the angular deflection thereof. The fret switches FSW are used for detecting an operated fret position for each string as designated by the fingering operation by a player. As best shown in FIG. 2, a push switch 8 (P1SW in FIG. 1) is attached to the tremolo arm 5*d* at its one end. In this embodiment, the push switch 8 serves as a musical tone color (timbre) selecting switch for selecting a tone color from various tone colors including piano, flute, etc.

Each time the player depresses the push switch 8 while holding the tremolo arm 5*d*, the next tone color is selected from the ordered cyclic list of tone colors. For example, pushed once, piano tone is selected, pushed again, flute tone is selected, and so on. In this manner, different tone colors are cyclically selected in response to successive depressions of the push switch 8. As shown in FIG. 1, a liquid crystal display unit (LCD) 9 is provided on the side face of the body 1 to display a name or number indicative of a tone color selected by operating the push switch 8.

Whole Circuit Arrangement

Figure 3:
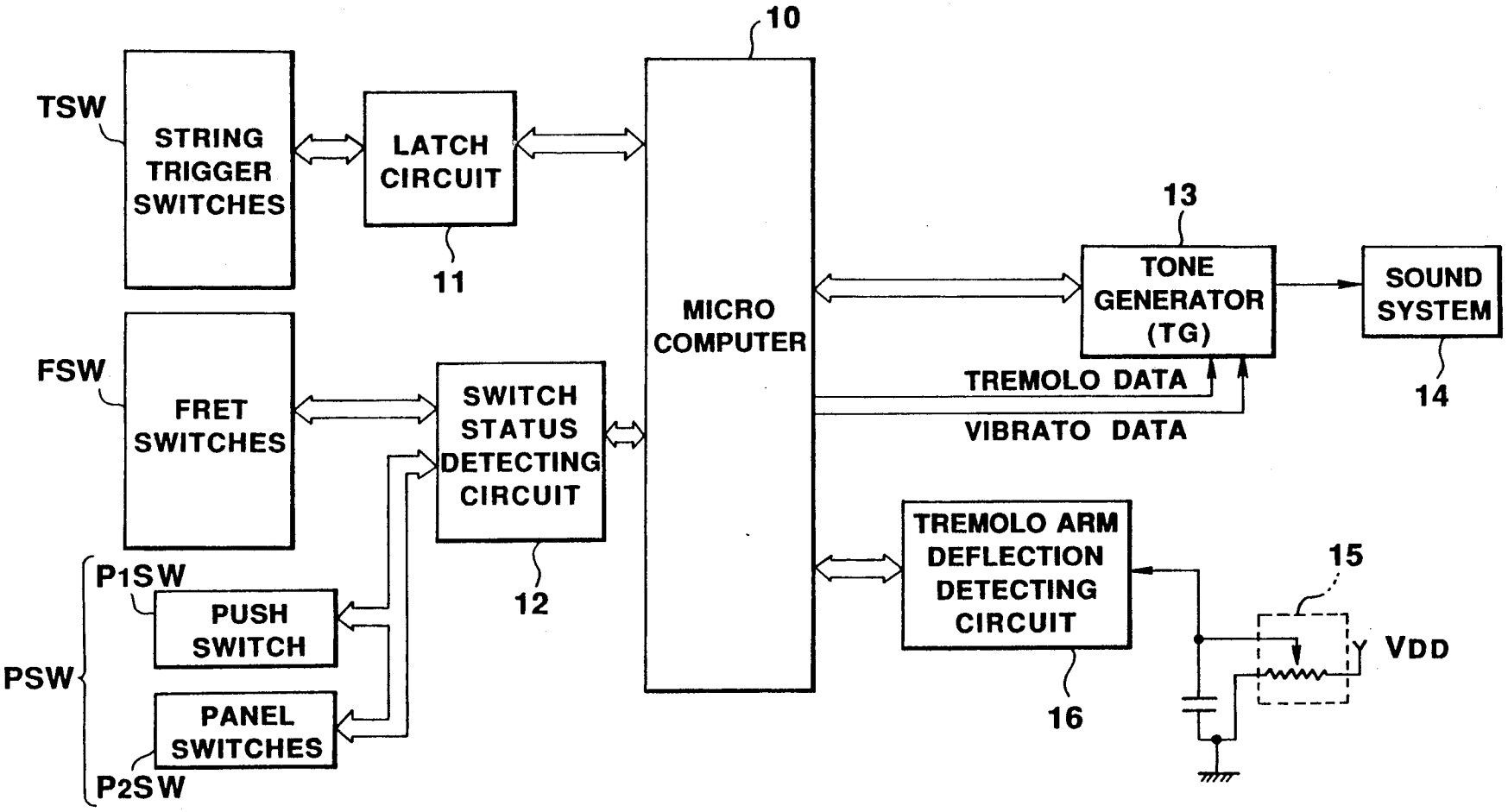
FIG. 3 is a diagram of an electronic circuit arrangement.

FIG. 3 shows a circuit arrangement applicable to the electronic stringed musical instrument of this embodiment. The string trigger switches TSW and fret switches FSW function as a plucking and fret position input device. To this end, a latch circuit 11 is provided as an interface circuit between the trigger switches TSW and a microcomputer 10. A switch status detecting circuit 12 is provided as an interface circuit between panel switches PSW and the microcomputer 10, and also as an interface circuit between the fret switches FSW and the microcomputer 10.

Above-mentioned tremolo arm 5*d* is coupled to a tremolo arm sensor 15 in the form of a variable resistor the value of which is a function of the angular deflection (amount of rotation) of the tremolo arm 5*d*. An analog output voltage level indicative of a tremolo arm deflection and corresponding to the resistance value of the sensor 15 is received by a tremolo arm deflection detecting circuit 16 which converts the analog voltage level to corresponding digital data by an internal A/D converter (not shown) and then supplies the digital data of arm deflection to the microcomputer 10. The microcomputer 10 modulates a pitch (frequency) of musical tone being currently generated in accordance with the digital value of the tremolo arm deflection.

Above-mentioned latch circuit 11 comprises a plurality of latch elements (flip-flops) equal in number to that of strings, and each connected to the individual string trigger switch TSW. Accordingly, when a string is plucked, corresponding switch TSW turns into a temporary on-state to set the related latch element. In a string trigger detecting operation in a general flow (described later is detail), the microcomputer 10 periodically samples the contents of each element of latch circuit 11 and detects which string(s) starts to vibrate by comparing the present samples with previous ones.

In response to the detection of the string vibration, a fixed reset time value is preset to a reset counter (not shown) in the microcomputer 10, and then each time a time interruption signal occurs, an associated interrupt routine (not shown) is performed to count down the reset counter. When the reset time has run out the latch element corresponding to the vibrated string is reset by the microcomputer 10. Thereby the triggering operation is detected speedy and surely while avoiding "chattering" due to bouncing of FSW.

Figure 4:
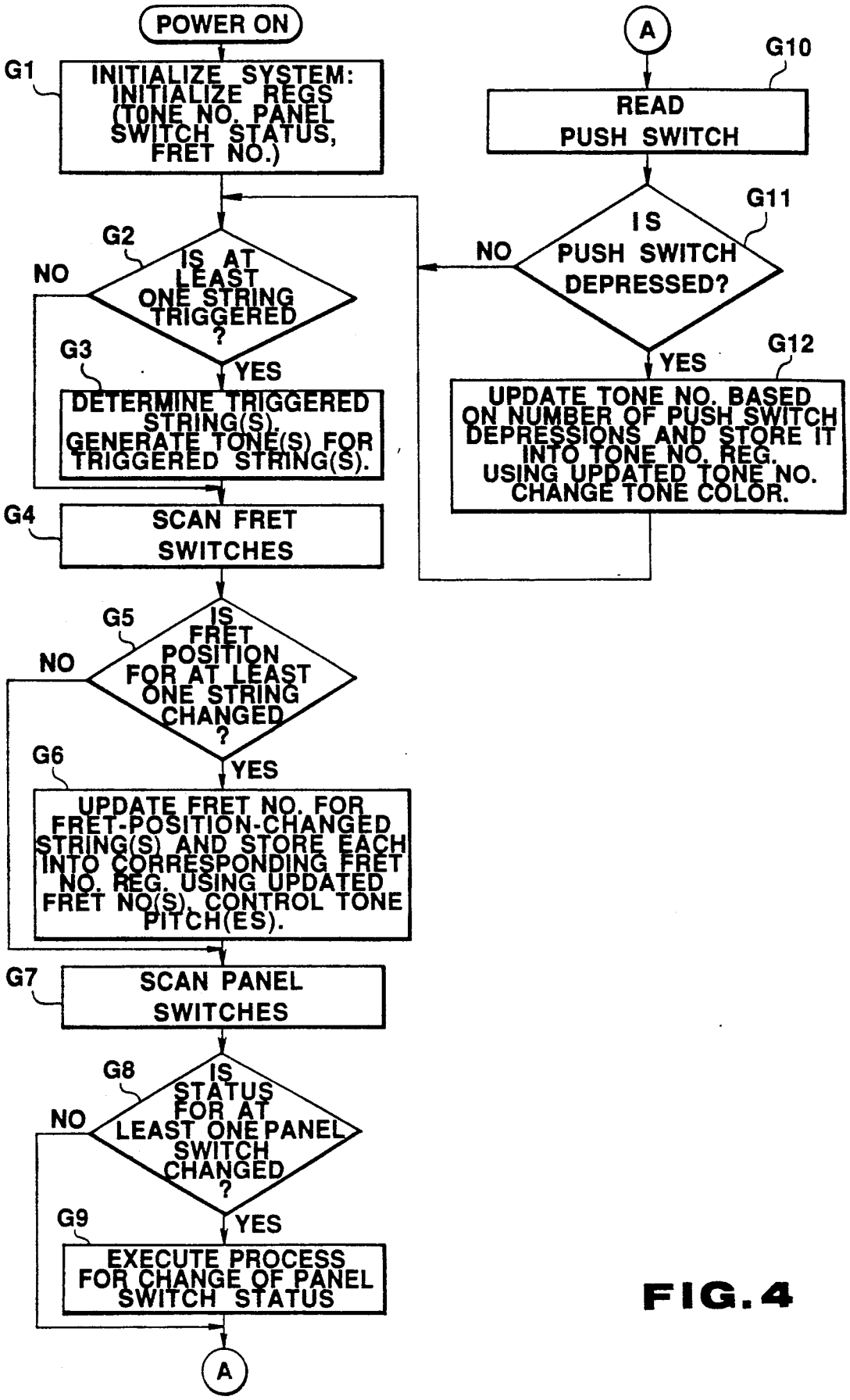
FIG. 4 shows a general flow chart of the preferred embodiment of this invention.

FIG. 4 shows a general flow chart of the microcomputer 10.

When power is turned on, the microcomputer 10 executes system initialization in step G1 in which initial data are preset to registers in the microcomputer 10. Among the registers are fret number registers associated with respective strings 4 for storing data corresponding to operated fret position designated by fret switches FSW, panel switch registers for storing data corresponding to operated state of the panel switches P2SW and a tone number register for storing data indicative of a selected tone color.

In the next step G2 the microcomputer 10 reads the latch circuit 11 to see whether or not at least one string starts vibrating (triggered) in response to the plucking operation of the strings. If this is the case, the microcomputer 10 executes step G3 to determine triggered string(s) and to control the tone generator 13 to generate a musical tone for each triggered string. Each tone pitch is determined by the data in the fret number register associated with the triggered string while the tone color is determined by the data in the tone color number register. If there is no string triggered, the microcomputer 10 jumps from step G2 to step G4 without generating any musical tone.

In the step G4, the microcomputer 10 reads operation state of the fret switches FSW from the switch status detecting circuit 12. In the next step G5 microcomputer 10 checks to see whether or not the present operation state of the fret switches FSW has changed. If this is the case, the microcomputer 10 executes step G6 to update a fret number for each string the operated fret position of which is changed, to store each updated fret number in the related fret number registers, and to change the pitch of the tone in TG13 for each position-changed string, using the updated fret number information. If no string has changed its fret position (G5), the microcomputer 10 skips over the step G6 to step G7.

In the step G7, the microcomputer 10 reads the operation state of panel switches P2SW. Then the microcomputer 10 checks in the next step G8 to see whether or not the present operation state of panel switches P2SW has changed from the previous operation state of panel switches P2SW already stored in the panel switch registers. If this is affirmative, the microcomputer 10 executes the process step G9 for the change of the panel switch state, including updating the data in the panel switch registers and starting/stopping an automatic rhythm performance, etc in accordance with the updated panel switch state. If no change is found between the present and the previous operation state of the panel switch P2SW, the microcomputer 10 advances to step G10 without executing step G9. In the step G10 the microcomputer 10 reads the state of the push switch P1SW. In the next step G11 the microcomputer 10 checks as to whether the push switch P1SW is operated (depressed) or not. If the push switch P1SW is operated, the microcomputer 10 executes the next step G12 to update a tone number in the tone number register (which functions as an N-module counter) based or the number of push switch depressions and to change the tone color data in TG13 for each string 4 using the updated tone number. In this manner, each time the push switch P1SW is operated, the value in the tone number register is successively and cyclically changed. For example if the changed value in the tone color number register is "1", a piano tone will be produced in TG3, and if the value is "2", a flute tone will be produced, and so on. If the push switch P1SW is not operated, step G12 is not executed.

Then, the microcomputer 10 reads the tremolo arm deflection sample from the circuit 16, and if the sample currently read has changed from the previous deflection sample, the microcomputer 10 calculates pitch modulation data as a function of the current arm deflection sample value, and supplies it to the tone generator 13 for affecting pitch modulation (not shown).

Therefore, the microcomputer 10 returns to the triggered-string check step G2 for continuation of the process mentioned above.

In operation, the player may depress the push switch just before, after or during the playing of the strings 4 while holding the tremolo arm. This pushing operation is signaled to the microcomputer 10 via the switch status detecting circuit 12. In this response, the microcomputer 10 selects a new tone color (e.g., piano tone) from the cyclically ordered list of tone colors and sets the data indicative of the selected tone color data in the tone generator 13. Once the new tone color data is set in TG13, and if at least one of the strings K is plucked, then the microcomputer 10 controls TG13 to generate a musical tone signal for each plucked string in which the musical tone signal has a tone color selected by the last operation of the push switch P1SW, and a musical pitch designated by the fret switch FSW operation. Each musical tone is sounded via a sound system 14.

While musical tones with a tone color selected by the push switch P1SW are generating as a result of the plucking operation of the strings 4, the tremolo arm **5*d* may be rotated or deflected. Then each pitch of the musical tones being currently generated is continuously varied as a function of the changing arm deflection of the tremolo arm 5*d*. If the push switch P1SW is pushed again, the tone color of the musical tones being generated in TG13 and outputted from the sound system 14** is changed.

Another Embodiment

In the embodiment presented above, the rotatable tremolo arm **5*d* is assigned an independent function of tone control from that of the push switch P1SW attached to the free end of the tremolo arm 5*d*. In particular, the tremolo arm deflection serves to modulate a musical parameter called "musical kitch" while the push switch operation functions to select a different value or instance of another musical parameter called "tone color". However, a musical instrument of the present invention may be arranged in a different way. That is, the functions of the tremolo arm 5*d*** and the push switch P1SW attached to the arm may be interrelated or associated so that each push switch operation results in a new parameter type selection from a plurality of different parameter or effect types (e.g., tremolo depth, rate; vibrato depth rate) while the tremolo arm deflection variably determines the value of a parameter the type of which is selected by the push switch P1SW.

In an embodiment, without any pushing of the push switch P1SW, a variable deflection of the tremolo arm **5*d*** will result in corresponding pitch modulation of the musical tone being generated in TG13 in the same manner as the above-mentioned embodiment.

However, when the push switch P1SW is pushed once, the microcomputer 10 changes an effect parameter type from the pitch modulation to a tremolo effect depth so that a variable deflection of the tremolo arm **5*d*** will in turn control the value of the tremolo depth as a function of the amount of the arm deflection.

Further, if the push switch P1SW is pushed again the microcomputer 10 changes the effect parameter type from the tremolo depth to a vibrato depth. At the time, the tremolo arm **5*d*** will cause a variation in the vibrato depth as a function of the value of the tremolo arm deflection.

Figure 5:
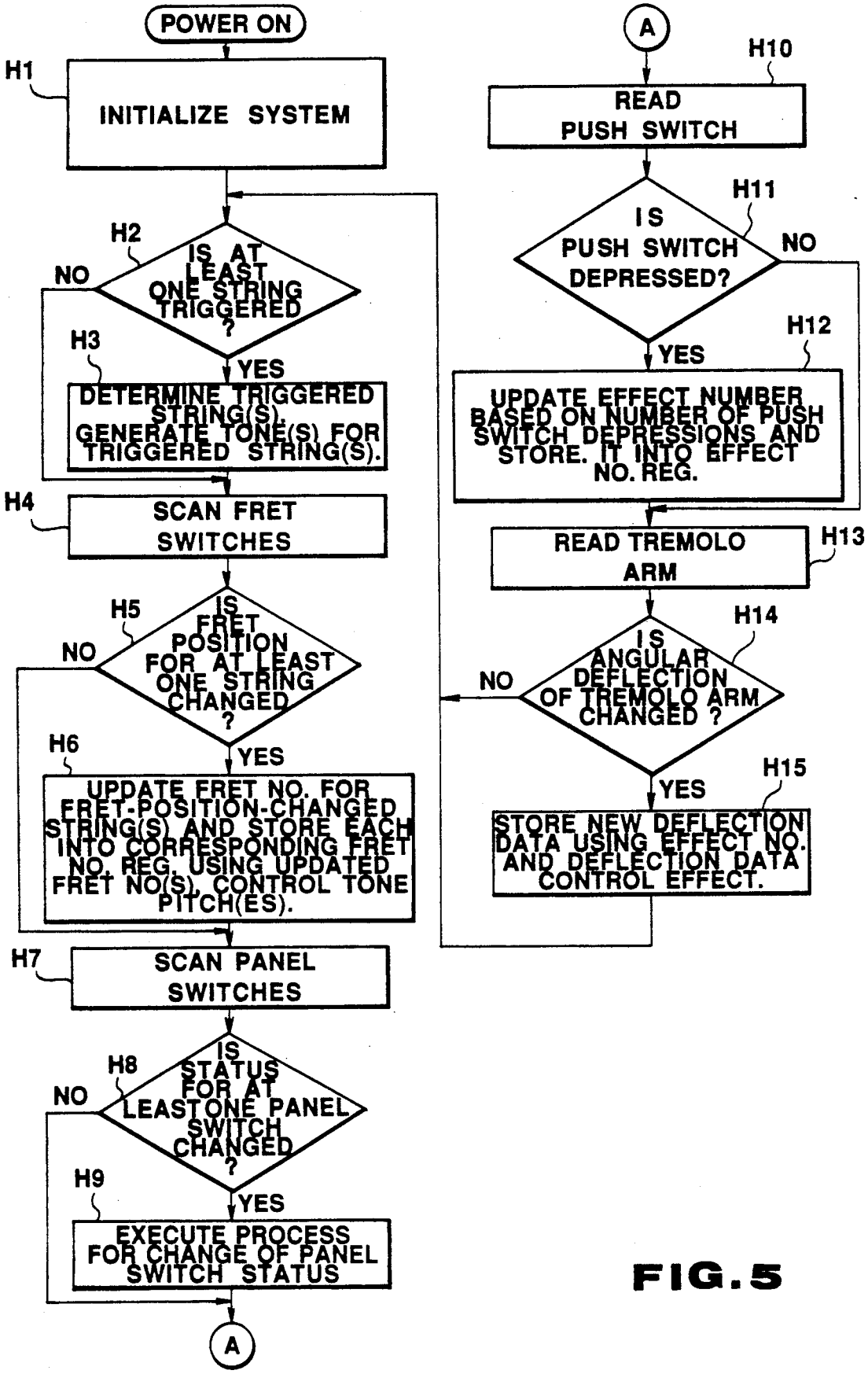
FIG. 5 shows a general flow chart of another preferred embodiment of this invention.

FIG. 5 shows a general flow chart of this embodiment. In this embodiment, the microcomputer 10 has an effect number (parameter type) register for storing effect number data indicative of the selected effect in place of the tone color number register of above-mentioned embodiment. The contents of the arm deflection register representative of the tremolo arm 15 deflection are reference to determine the value of the selected effect. In step G1, the system is initialized. Step H1 includes setting of the effect number register to an initialized value indicative of the pitch modulation as well as initializing other registers. Steps H2 to H11 are substantially identical to steps G2 to G11 of FIG. 4. In the step H11, if the microcomputer 10 detects the push switch P1SW is operated, it advances to step H12 to update the contents of the effect number register (which functions as a modulo N counter) based on the number of the push switch P1SW depressions. The contents of the effect number register, which are cyclically changed in response to the successive push switch P1SW operations, indicate a selected type of musical effect to be controlled by the tremolo arm 5*d* mounting the push switch at the end. For example, if the changed value of the effect number register is "1", this means that a tremolo effect is selected, and if the changed value is "2", a vibrato effect is selected and so on. In step H13, the microcomputer 10 detects the amount of the angular deflection of the tremolo arm 5*d*. Then in step H14 the microcomputer 10 checks to see whether or not the present amount of the deflection of the tremolo arm 5*d* has changed from the previous one. In the affirmative case, the microcomputer 10 executes step H15 to store the current deflection data, produce effect data as a function of the current tremolo arm deflection data with respect to the effect type assigned by the push switch P1SW, and transfer it to the tone generator 13 so that the corresponding effect parameter of musical tones being generated in TG13 will be varied accordingly. If there is no change of the amount of the tremolo arm 5*d* (H14), the microcomputer 10 skips over the effect step H15, returning to the step H2 for repeating the process.

In this manner, the push switch P1SW serves as a variable function (musical effect) assignor for the tremolo arm 5*d* mounting the push switch so that the tremolo arm 5*d* may function as a variable effect controller. For example, without any pushing of the push switch P1SW (effect number=0 with respect to module N), the tremolo arm 5*d* functions as a pitch modulator or bender for modulating the pitch of musical tones in TG13. For the first pusing of the push switch P1SW (or effect number=1 with respect to module N), the tremolo arm 5*d* serves as a tremolo depth modulator or controller for modulating the amplitude of musical tone signals in TG13. For the second depressing of the push switch P1SW, the tremolo arm 5*d* turns out to be a vibrato depth controller for modulating the vibrato depth (width or span of periodically varying pitches) of musical tones in the tone generator 13. Since the push switch P1SW is attached to the tremolo arm 5*d*, it will be much easier for the player to manipulate either of the tremolo arm 5*d* and the attached push switch P1SW in the course of playing the stringed instrument, thus enriching the musical performance attainable with the electronic stringed instrument, while avoiding no substantial interruption of the plucking operation of the strings.

The present invention may be practiced or embodied in still other ways without departing from the spirit or essential characteristic thereof. For example, the present invention may also apply to an electronic stringed instrument of the type employing pitch extracting electronics for extracting a pitch or fundamental frequency from a vibrating string with respect to each string such as disclosed in U.S. Pat. No. 4,817,484. In this application, the tremolo arm may be arranged independently of the strings, if desired, so that the tremolo arm operation will not influence the tension of each string, which, otherwise would cause a pitch variation in the reading of the pitch extracting electronics. Therefore, the preferred embodiments described herein are illustrative and not restrictive, the scope of the invention being indicated by the appended claims and all variations which come within the meaning of the claims are intended to be embraced therein.

What is claimed is:

1. An electronic stringed musical instrument for generating a musical tone signal with a pitch which is designated by a pitch designating operation in response to a plucking operation for each of at least one string stretched on a main body of the stringed musical instrument, comprising:

a manually operable lever which has a shape of a bar deflectably mounted on the main body of said stringed musical instrument and being positioned adjacent to said at least one string;

a single push switch attached to one end of said manually operable lever;

kind selecting means coupled to said single push switch for each time when said single push switch is pushed, selecting a kind of parameter of a musical tone which parameter is difference from a kind of parameter previously selected by the push switch; and parameter varying means coupled to said manually operable lever for varying a value of a parameter of the kind selected by said kind selecting means in accordance with an amount of deflection of said manually operable lever.

2. The electronic stringed musical instrument of claim 1, wherein said kind of the parameter selected by said kind selecting means is a musical effect which is imparted to each musical tone to be generated.

3. The electronic stringed musical instrument of claim 2, wherein said kind selecting means selects said musical effect which is one of a vibrato effect, a tremolo effect and a pitch bend effect.

4. The electronic stringed musical instrument of claim 1, which further comprises a tone generating means responsive to plucking of any of said at least one string, for generating for each plucked string a musical tone signal with a pitch designated by a pitch designating operation for said each plucked string.

5. An electronic stringed musical instrument for generating a musical tone signal with a pitch which is designated by a pitch designating operation in response to a plucking operation for each of at least one string stretched on a main body of the stringed musical instrument, comprising:

a manually operable lever which has a shape of a bar deflectably mounted on the main body of said stringed musical instrument and being positioned adjacent to said at least one string;

a single push switch attached to one end of said manually operable lever;

musical effect selecting means coupled to said single push switch for, each time when said single push switch is pushed, selecting a musical effect to be imparted to a musical tone to be generated, which effect is difference from a musical effect previously selected by the push switch; and effect depth varying means coupled to said manually operable lever for varying a depth of said musical effect selected by said musical effect selecting means in accordance with an amount of deflection of said manually operable lever.

6. The electronic stringed musical instrument of claim 5, wherein said musical effect selecting means selects said musical effect which is one of a vibrato effect, a tremolo effect and a pitch bend effect.

7. The electronic stringed musical instrument of claim 5, which further comprises a tone generating means responsive to plucking of any of said at least one string, for generating for each plucked string a musical tone signal with a pitch designated by a pitch designating operation for said each plucked string.

* * * * *

UNITED STATES PATENT AND TRADEMARK OFFICE

CERTIFICATE OF CORRECTION

PATENT NO. : 5,085,120

DATED : February 4, 1992

INVENTOR(S) : Shiro ISHIGURO

It is certified that error appears in the above-identified patent and that said Letters Patent is hereby corrected as shown below:

Title page, right column, after Abstract:

Change "10 Claims" to --7 Claims--.

Signed and Sealed this

Twentieth Day of July, 1993

*Attest:*

Michael K. Kirk

MICHAEL K. KIRK

*Attesting Officer*

*Acting Commissioner of Patents and Trademarks*